US011141972B2

(12) United States Patent
Kobayashi

(10) Patent No.: US 11,141,972 B2
(45) Date of Patent: Oct. 12, 2021

(54) LIQUID EJECTING DEVICE AND A METHOD FOR CORRECTING LANDING POSITION DEVIATION OF LIQUID

(71) Applicant: SEIKO EPSON CORPORATION, Tokyo (JP)

(72) Inventor: Toshiyuki Kobayashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/742,222

(22) Filed: Jan. 14, 2020

(65) Prior Publication Data

US 2020/0230951 A1 Jul. 23, 2020

(30) Foreign Application Priority Data

Jan. 17, 2019 (JP) ..... JP2019-005789

(51) Int. Cl.
*B41J 2/045* (2006.01)
*B41J 25/308* (2006.01)

(52) U.S. Cl.
CPC ..... *B41J 2/04506* (2013.01); *B41J 2/04505* (2013.01); *B41J 2/04508* (2013.01); *B41J 2/04573* (2013.01); *B41J 2/04586* (2013.01); *B41J 25/308* (2013.01)

(58) Field of Classification Search
CPC B41J 2/04505; B41J 2/04506; B41J 2/04508; B41J 2/04573
See application file for complete search history.

(56) References Cited

U.S. PATENT DOCUMENTS

2006/0132527 A1* 6/2006 Cordery ..... B41J 29/393 347/19
2006/0274107 A1* 12/2006 Anderson ..... B41J 29/393 347/20
2015/0116394 A1* 4/2015 Izuo ..... B41J 2/04505 347/8

FOREIGN PATENT DOCUMENTS

| | | |
|---|---|---|
| JP | 2007-030193 | 2/2007 |
| JP | 2009-066902 | 4/2009 |
| JP | 4273819 | 6/2009 |
| JP | 2009286141 | 12/2009 |

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid ejecting device includes a supporting unit supporting a medium, an ejecting unit ejecting liquid onto the medium, a scanning driving unit moving the ejecting unit, and a control unit controlling the ejecting unit and the scanning driving unit. The control unit is configured to be capable of performing, a first processing for forming a test pattern, and acquiring an ejection velocity parameter associated with an ejection velocity of the liquid detected from the test pattern, a second processing for calculating the ejection velocity of the liquid from the ejection velocity parameter, calculating a first correction component that depends on the calculated ejection velocity, and setting a correction value including the first correction component, and a third processing for correcting ejection timing of the liquid using the correction value, when the liquid is ejected from the ejecting unit onto the medium as the ejecting unit is moved.

11 Claims, 9 Drawing Sheets

LIQUID EJECTING DEVICE AND A METHOD FOR CORRECTING LANDING POSITION DEVIATION OF LIQUID

The present application is based on, and claims priority from JP Application Serial Number 2019-005789, filed Jan. 17, 2019, the disclosure of which is hereby incorporated by reference herein in its entirety.

BACKGROUND

1. Technical Field

The present disclosure relates to a liquid ejecting device for ejecting liquid onto a medium, and particularly relates to a technique for correcting landing position deviation of liquid.

2. Related Art

JP-A-2009-286141 discloses a printing apparatus capable of performing bi-directional printing in which printing is performed by reciprocating a carriage having a printing head mounted thereon. In this printing apparatus, there is a possibility that landing position deviation of ink may occur in a forward path and a backward path during the bi-directional printing. Thus, in the related art, landing position deviation during bi-directional printing is corrected by printing a correction pattern by the bi-directional printing, detecting the printed correction pattern with a concentration detecting unit, and adjusting ejection timing of the ink based on the detection result.

The landing position deviation of ink may occur due to other factors different from the ejection timing during the bi-directional printing, and the landing position deviation of ink occurs even in single direction printing. One of the factors of the landing position deviation is an error in an ink ejection velocity caused by, for example, characteristic differences among printing heads. However, in the past, there has been a problem in that sufficient consideration has not been made to correct the landing position deviation due to the error in the ink ejection velocity. This problem is not limited to printing apparatuses, and is a common problem with other types of liquid ejecting devices that eject liquid other than ink from ejecting units.

SUMMARY

According to an aspect of the present disclosure, there is provided a liquid ejecting device for ejecting liquid onto a medium. The liquid ejecting device includes a supporting unit configured to support the medium, an ejecting unit configured to eject the liquid onto the medium supported by the supporting unit, a scanning driving unit configured to move the ejecting unit along a scanning direction, and a control unit configured to control the ejecting unit and the scanning driving unit. The control unit is configured to be capable of performing, a first processing for ejecting the liquid from the ejecting unit onto the medium to form an ejection velocity test pattern for determining an ejection velocity of the liquid, and acquiring an ejection velocity parameter associated with an ejection velocity of the liquid detected from the ejection velocity test pattern, a second processing for calculating an ejection velocity of the liquid from the ejection velocity parameter, calculating a first correction component that depends on the calculated ejection velocity, and setting a correction value including the first correction component, and a third processing for correcting ejection timing of the liquid using the correction value, when the liquid is ejected from the ejecting unit onto the medium as the ejecting unit is moved.

DESCRIPTION OF EXEMPLARY EMBODIMENTS

Figure 1:
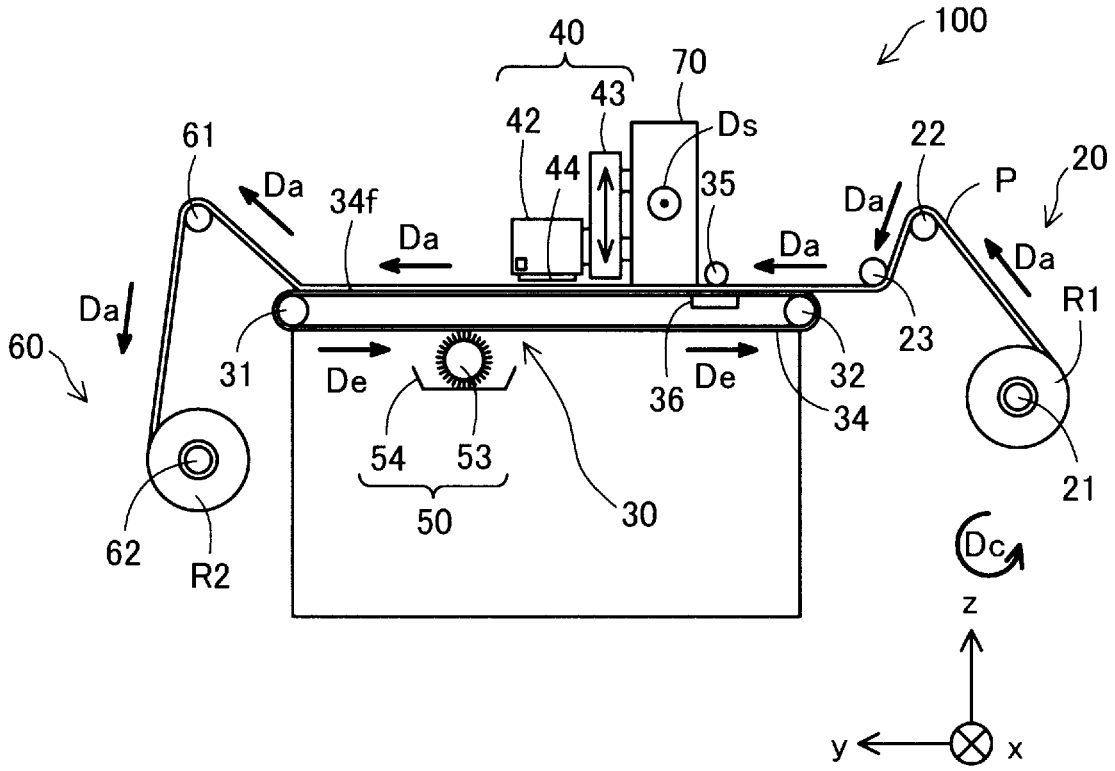
FIG. 1 is a right side view illustrating a printing apparatus as an exemplary embodiment of a liquid ejecting device.

A. Configuration of Apparatus:

FIG. 1 is a right side view of a printing apparatus 100 as an exemplary embodiment of a liquid ejecting device. In other words, a left side of a paper surface of FIG. 1 corresponds to a front side of the printing apparatus 100, and a right side of the paper surface corresponds to a rear side. An x-axis direction is a direction from a right side surface toward a left side surface of the printing apparatus 100, a y-axis direction is a direction from a back side toward a front side of the printing apparatus 100, and a z-axis direction is a direction vertically upward. The x-, y-, z-axis directions are orthogonal to each other. X-, y-, z-axis directions in other views also illustrate identical directions to those in FIG. 1.

The printing apparatus 100 includes a feeding portion 20, a transport unit 30, a carriage 40, a cleaning unit 50, a winding unit 60, and a scanning driving unit 70.

The feeding portion 20 is a mechanism for feeding a roll R1 of a medium P to be printed on which printing is performed. The medium P to be printed is simply referred to as a "medium P". The feeding portion 20 is configured to be able to feed the medium P to the transport unit 30 from the roll R1 set on a rotary shaft 21 via driven rollers 22 and 23. When the medium P is fed to the transport unit 30, the rotary shaft 21 rotates in a rotation direction Dc.

The transport unit 30 is a mechanism for transporting the medium P in a transport direction Da by a transporting belt 34. In the present exemplary embodiment, the transporting belt 34 is an endless belt. An adhesive layer for affixing the medium P to a support face 34*f* of the transporting belt 34 is formed at a front surface of the transporting belt 34. However, a belt other than an adhesive belt may be used as the transporting belt 34, and for example, an electrostatic adsorption type belt may be used. The support face 34*f* of the transporting belt 34 corresponds to a "supporting unit" that supports the medium P. In addition to the transporting belt 34, the transport unit 30 includes a driving roller 31 that moves the transporting belt 34 in a direction De, a driven roller 32, a pressing roller 35, and a belt supporting unit 36.

The driving roller 31 rotates in the rotation direction Dc in transporting the medium P. The medium P is affixed to the front surface of the transporting belt 34 by being pressed against the support face 34*f* of the transporting belt 34 between the pressing roller 35 and the belt supporting unit 36. The pressing roller 35 is configured so as to be able to reciprocate along the transport direction Da in order to suppress contact marks from being made on the medium P by contacting at an identical location of the medium P for a fixed amount of time.

The carriage 40 includes a head holding unit 42 that holds a printing head 44, and a gap adjusting unit 43. The gap adjusting unit 43 is a mechanism for adjusting a gap between a front surface of the printing head 44 and the medium P. In the present exemplary embodiment, the gap adjusting unit 43 uses a cam mechanism, and it is possible to move the head holding unit 42 along the z-axis direction by rotating a cam. The printing head 44 performs printing by ejecting ink onto the medium P. Configuration examples of the printing head 44 will be described later.

The cleaning unit 50 is a mechanism for cleaning the front surface of the transporting belt 34. The cleaning unit 50 includes a cleaning brush 53 contacting the front surface of the transporting belt 34, and a tray 54 containing cleansing agents for cleaning the cleaning brush 53. As the cleaning brush 53 rotates, the front surface of the transporting belt 34 is cleaned by the cleaning brush 53, and the cleaning brush 53 itself is cleaned in the tray 54.

The winding unit 60 is a mechanism for winding the medium P after the printing. The winding unit 60 includes a driven roller 61 and a winding shaft 62. A winding paper tube is set on the winding shaft 62, and the medium P transported via the driven roller 61 from the transport unit 30 can be wound as a roll R2.

The scanning driving unit 70 is a mechanism for scanning the carriage 40. The "scanning" means moving the carriage 40 in a scanning direction Ds or in a reverse direction thereof. The scanning direction Ds is also referred to as a "forward path direction", and the reverse direction thereof is also referred to as a "backward path direction". In the present exemplary embodiment, the scanning direction Ds is opposite to the x-axis direction, but the scanning direction Ds may be defined in an identical orientation to the x-axis direction. The printing is performed by ejecting ink from the printing head 44 while moving the carriage 40 in the forward path direction or the backward path direction. During the printing, the ink is ejected from the printing head 44 while the carriage 40 is moved, but while the carriage 40 is moved, the transport unit 30 stops transporting the medium P. In other words, during the printing, the scanning on the forward path or the backward path of the carriage 40 and the transportation of the medium P are alternately performed.

As the medium P, a printing-target material can be used. The printing-target material refers to a subject of printing, such as fiber, garments, and other cloth products. Fiber includes woven cloth, knit fabric, and non-woven cloth, for example, made of natural fiber such as cotton, hemp, silk, and wool, of chemical fiber such as nylon, and of composite fiber of natural fiber and chemical fiber. Garments and other cloth products include fabricated products, such as a T-shirt, handkerchief, scarf, towel, handbag, fabric bag, and furniture-related products including a curtain, sheet, and bed cover, as well as include fiber before and after cutting to serve as parts before fabrication. In addition to the printing-target materials described above, the medium P may be special paper for ink-jet printing, such as plain paper, pure paper, and glossy paper. The medium P may also be, for example, a plastic film not having undergone surface treatment for ink-jet printing (i.e., not formed with an ink absorption layer), as well as one coated with a plastic material on a base material, such as paper, and one adhered with a plastic film on a substrate, such as paper. As described above, a wide variety of materials can be used as the medium P, and a thickness of the medium P also falls within a wide range. An operator of the printing apparatus 100 can use the gap adjusting unit 43 to adjust a value of the gap between the front surface of the printing head 44 and the medium P to an appropriate value suitable for the medium P.

Figure 2:
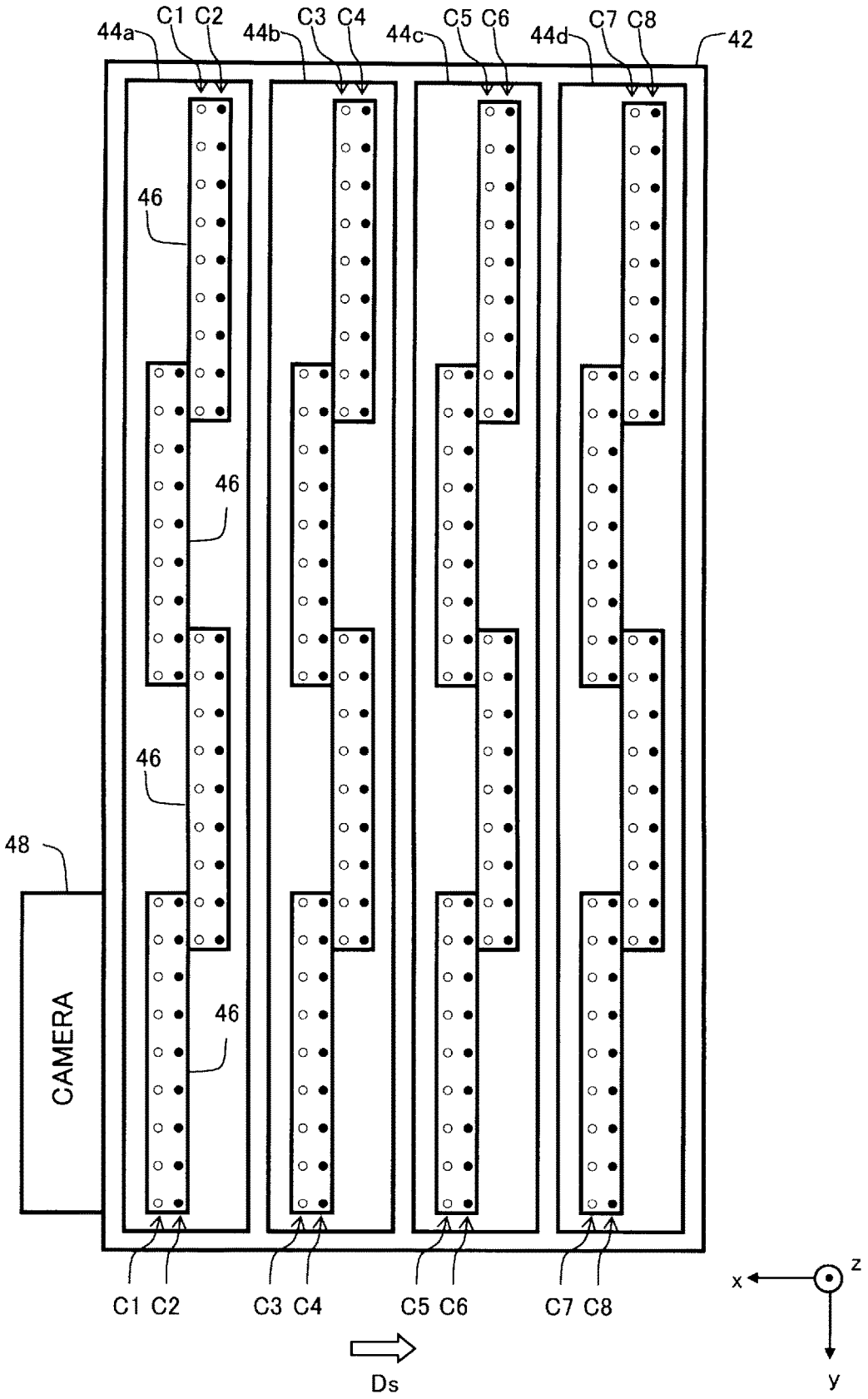
FIG. 2 is a plan view illustrating an arrangement of printing heads.

FIG. 2 is a plan view illustrating an arrangement of the printing heads 44. Here, for convenience of description, a state is illustrated in which the head holding unit 42 is seen-through from above. The head holding unit 42 includes a plurality of printing heads 44*a* to 44*d*, and a camera unit 48. Since configurations of the plurality of printing heads 44*a* to 44*d* are identical, each of the printing heads is referred to as the "printing head 44" in a case where there is no need to distinguish the printing heads from each other. The camera unit 48 can be used to capture a test pattern formed at the medium P.

Each of the printing heads 44 has a configuration in which a plurality of nozzle tips 46 are arranged in a staggered manner. The "nozzle tip 46" means a sintered body in which a plurality of nozzles are formed. The plurality of nozzle tips 46 are combined to configure one number of the printing head 44, and the plurality of printing heads 44 are assembled to the head holding unit 42. The first printing head 44*a* is an aggregate in which four number of the nozzle tips 46 are combined, and has two nozzle rows C1 and C2. Nozzles of the first nozzle row C1 are drawn with open circles, and nozzles of the second nozzle row C2 are drawn with black circles. The other printing heads 44*b* to 44*d* are also configured similar to the first printing head 44*a*, and eight nozzle rows C1 to C8 are formed by an entirety of the four printing heads 44*a* to 44*d*. Eight different colors of ink can be ejected from these eight nozzle rows C1 to C8. Note that, in FIG. 2, only nine number of the nozzles are drawn for one row of one number of the nozzle tip 46, but in reality, the number of nozzles for one row is several tens to hundreds. A reason that the plurality of nozzle tips 46 constituting one number of the printing head 44 are arranged in a staggered manner is that the nozzles are arranged at a constant pitch along a direction perpendicular to the scanning direction Ds. Of a plurality of nozzles that constitute one nozzle row, some of the nozzles at positions overlapping along the scanning direction Ds serve as dummy nozzles that are not used to eject ink. Note that, the configuration and arrangement of the printing heads 44 illustrated in FIG. 2 is an example, and various other configurations and arrangements can be employed other than the above. For example, one number of the printing head 44 may be configured with one number of the nozzle tip 46. In addition, it is not necessary to provide the head holding unit 42 with the plurality of printing heads 44, and it may be possible to provide only one number of the printing head 44.

In the present exemplary embodiment, ink ejection timing correction described below is performed for each of the printing heads 44. However, ejection timing may be corrected for each of the nozzle tips 46 rather than for each of the printing heads 44. In the present specification, an object that serves as a unit of correction for ejection timing of liquid is referred to as the "ejecting unit". In the present exemplary embodiment, the individual printing head 44 corresponds to the "ejecting unit".

Figure 3:
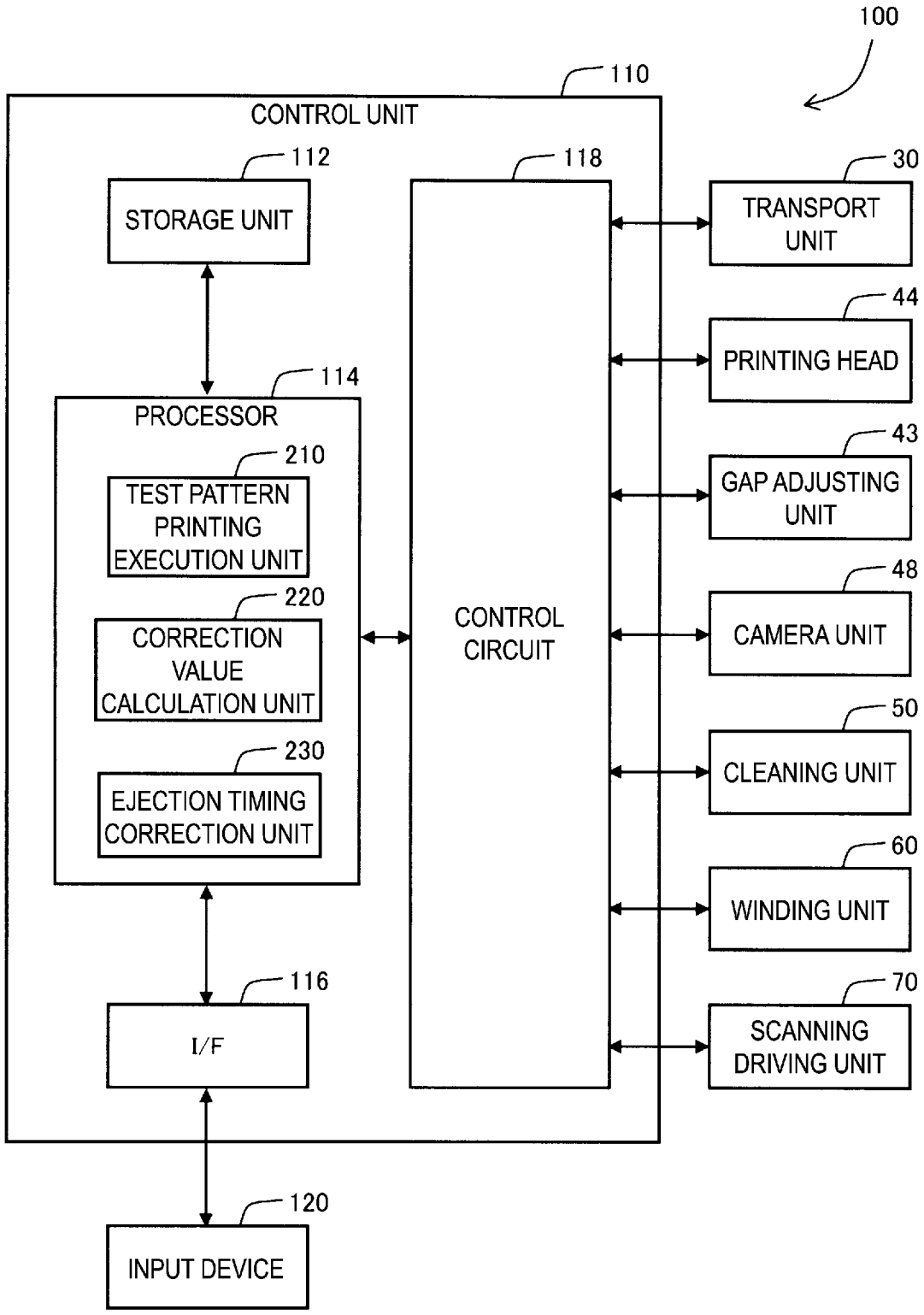
FIG. 3 is a functional block diagram of the printing apparatus.

FIG. 3 is a functional block diagram of the printing apparatus 100 according to the present exemplary embodiment. The printing apparatus 100 includes a control unit 110 and an input device 120. The control unit 110 includes a storage unit 112, a processor 114, an input/output interface 116, and a control circuit 118.

The processor 114 performs control of each of the units illustrated in FIG. 1 via the control circuit 118. Additionally, the processor 114 functions as a test pattern printing execution unit 210, a correction value calculation unit 220, and an ejection timing correction unit 230. The test pattern printing execution unit 210 controls execution of printing of a test pattern. The correction value calculation unit 220 calculates a correction value for correcting ink ejection timing. The ejection timing correction unit 230 corrects the ink ejection timing during printing using the correction value. The functions of each of these units are realized by executing a computer program stored in the storage unit 112. However, some or all of these functions may be realized by hardware circuits.

The input device 120 is coupled to the input/output interface 116, and supplies print data to the control unit 110. Additionally, the operator of the printing apparatus 100 can use the input device 120 to instruct execution of a correction process for the ink ejection timing, or to input parameters used in calculating the correction value.

Figure 4:
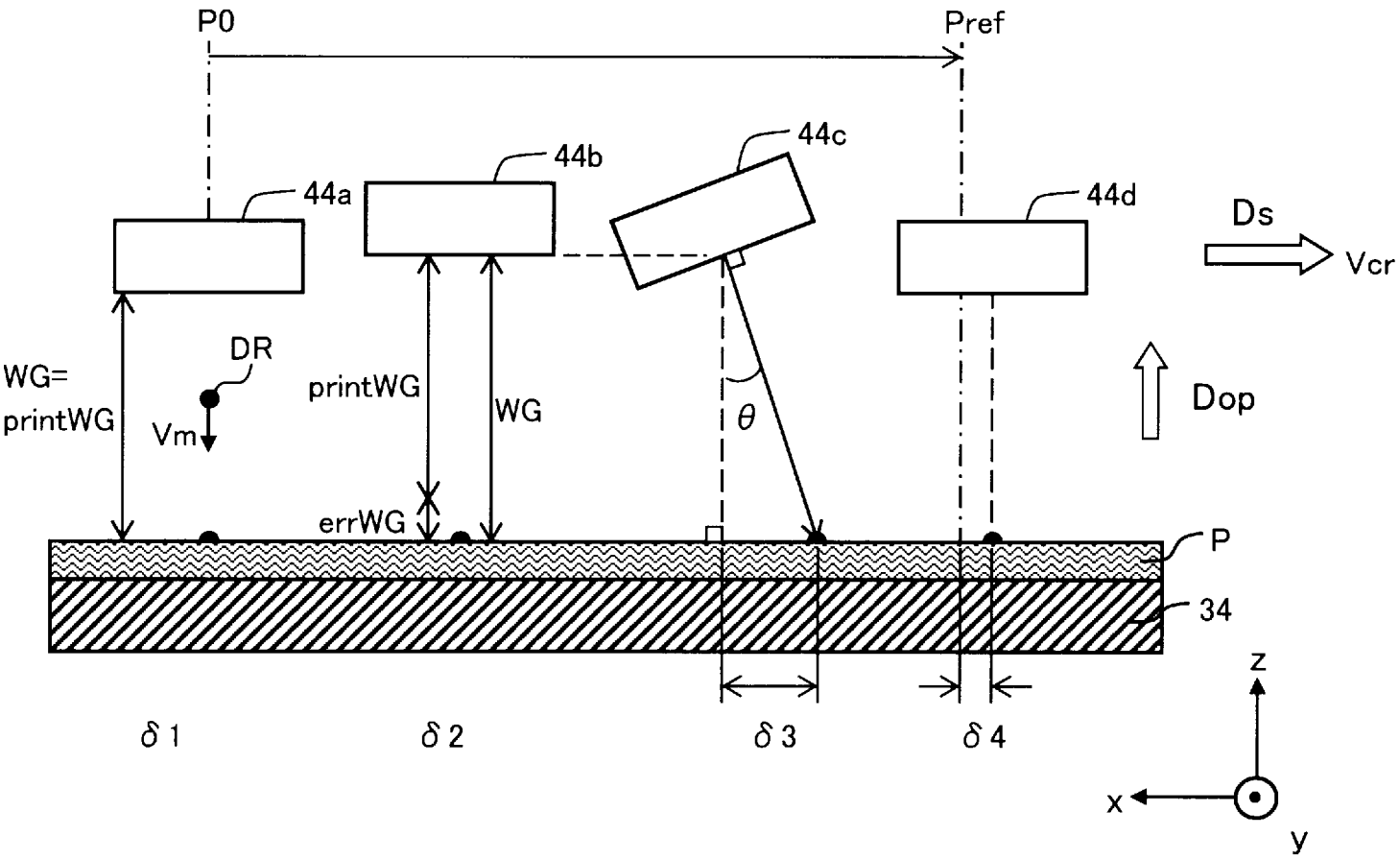
FIG. 4 is an explanatory diagram illustrating components of a correction value for ejection timing.

B. Summary of Ejection Timing Correction:

FIG. 4 is an explanatory diagram illustrating components of a correction value for ink ejection timing. Four correction components δ1 to δ4 of ejection timing are illustrated below the four printing heads 44*a* to 44*d*. Meanings of respective reference signs illustrated in FIG. 4 are as follows.

δ1 to δ4: first to fourth correction components

P0: a mounting position of the printing head 44*a* serving as a reference.

Pref: a correct mounting position of the printing head 44*d*.

Vcr: a movement velocity of the printing head 44.

Vm: an ejection velocity of an ink droplet DR, i.e., a velocity at which the ink droplet DR flies in the air.

WG: a real value of a work gap, which is a distance between the medium P and the printing head 44, and WG=printWG+errWG.

errWG: a work gap error, which is a mounting error of the printing head 44.

printWG: a set value of the work gap inputted by the operator.

θ: an inclination error of the printing head 44.

While the four correction components δ1 to δ4 are illustrated below the four printing heads 44*a* to 44*d* in FIG. 4, this is merely for illustration convenience, and the four correction components δ1 to δ4 may be applied to one number of the identical printing head 44.

In the present exemplary embodiment, a correction value δtotal for the ejection timing is given as a sum of the four correction components δ1 to δ4. A unit of the correction value δtotal is distance.

[Mathematical Equation 1]

[Mathematical Equation 1]

$$\delta total = \delta 1 + \delta 2 + \delta 3 + \delta 4 \quad (1a)$$

$$\delta 1 = \frac{printWG}{Vm} \times Vcr \quad (1b)$$

-continued $$\delta 2 = \frac{errWG}{Vm} \times Vcr \quad (1c)$$

$$\delta 3 = WG \times \tan\theta \quad (1d)$$

$$\delta 4 = \text{constant}. \quad (1e)$$

The first correction component δ1 is a component that depends on the ejection velocity Vm of the ink droplet DR, and also depends on the set value printWG of the work gap and the movement velocity Vcr of the printing head 44. Specifically, the first correction component δ1 is a value obtained by dividing the set value printWG of the work gap by the ejection velocity Vm of the ink droplet DR, and multiplying by the movement velocity Vcr of the printing head 44. This first correction component δ1 corresponds to a difference between a landing position of the ink droplet DR when assuming the movement velocity Vcr is zero, and a landing position when the movement velocity Vcr is not zero. As described above, since ink is ejected while the printing head 44 is moved in the scanning direction Ds during printing, a landing position of an ink dot on the medium P is deviated, when the ejection velocity Vm changes due to an error in characteristics of the printing head 44. Thus, in the present exemplary embodiment, as described below, the ejection velocity Vm of each of the printing heads 44 is detected from an ejection velocity test pattern. Note that, for the first correction component δ1, the work gap error errWG is not considered, and the work gap error errWG is considered for the second correction component δ2.

The second correction component δ2 is a component that depends on the work gap error errWG, and also depends on the ejection velocity Vm of the ink droplet DR and the movement velocity Vcr of the printing head 44. The work gap error errWG is a difference between the set value printWG for the work gap and an actual work gap WG, and corresponds to the mounting error of the printing head 44 along an opposing direction Dop in which the printing head 44 as the ejecting unit and the medium P face each other. The second correction component δ2 is, specifically, a value obtained by dividing the work gap error errWG by the ejection velocity Vm of the ink droplet DR, and multiplying by the movement velocity Vcr of the printing head 44. The work gap error errWG may vary for the individual printing heads 44. Thus, in the present exemplary embodiment, as described below, the work gap error errWG of each of the printing heads 44 is detected from a mounting error test pattern. Note that, as can be understood by comparing the above-described Mathematical Equations 1b and 1c, the second correction component δ2 has a much smaller value than the first correction component δ1.

The third correction component δ3 is a component that depends on the inclination error θ of the printing head 44, and also depends on the work gap WG. The inclination error θ corresponds to an inclination error of the printing head 44 with respect to the opposing direction Dop in which the printing head 44 as the ejecting unit and the medium P face each other. Note that, the inclination error θ corresponds to an inclination with a y-axis in the printing head 44 as a rotation axis, as illustrated in FIG. 4. Specifically, the third correction component δ3 is a value obtained by multiplying the work gap WG by tan θ. Note that, in the above Mathematical Equation 1d, instead of the actual work gap WG, or the actual value of the work gap, the set value printWG of the work gap may be used. This is because the third correction component δ3 is sufficiently small compared to the first correction component δ1, and thus a contribution of the work gap error errWG to the third correction component δ3 is negligible. Note that, the inclination error θ of the printing head 44 is measured during assembly of the head holding unit 42, for example. The third correction component δ3 is typically a value that is significantly smaller than the first correction component δ1.

The fourth correction component δ4 is a component that depends on the mounting error of the printing head 44 along the scanning direction Ds, and is set with "constant" or a constant in the above Mathematical Equation 1e. In the example in FIG. 4, the correct mounting position Pref of the fourth printing head 44*d* is set with reference to the mounting position P0 of the printing head 44*a* serving as the reference. However, an actual mounting position of the fourth printing head 44*d* is deviated from the correct mounting position Pref, and this amount of deviation corresponds to the fourth correction component δ4. Note that, the fourth correction component δ4 is measured when the head holding unit 42 is assembled, for example. In addition, the fourth correction component δ4 is set to zero for the printing head 44*a* serving as the reference. The fourth correction component δ4 is typically a value that is significantly smaller than the first correction component δ1.

Of the four correction components δ1 to δ4 constituting the correction value δtotal of the ejection timing, the first correction component δ1 is the largest, and the other correction components δ2 to δ4 are sufficiently smaller than the first correction component δ1. Accordingly, the correction value δtotal may be calculated using only the first correction component δ1 without using the second to fourth correction components δ2 to δ4. However, when one or more of the second to fourth correction components δ2 to δ4 are used together with the first correction component δ1 to calculate the correction value δtotal, it is possible to further accurately correct the ejection timing.

Figure 5:
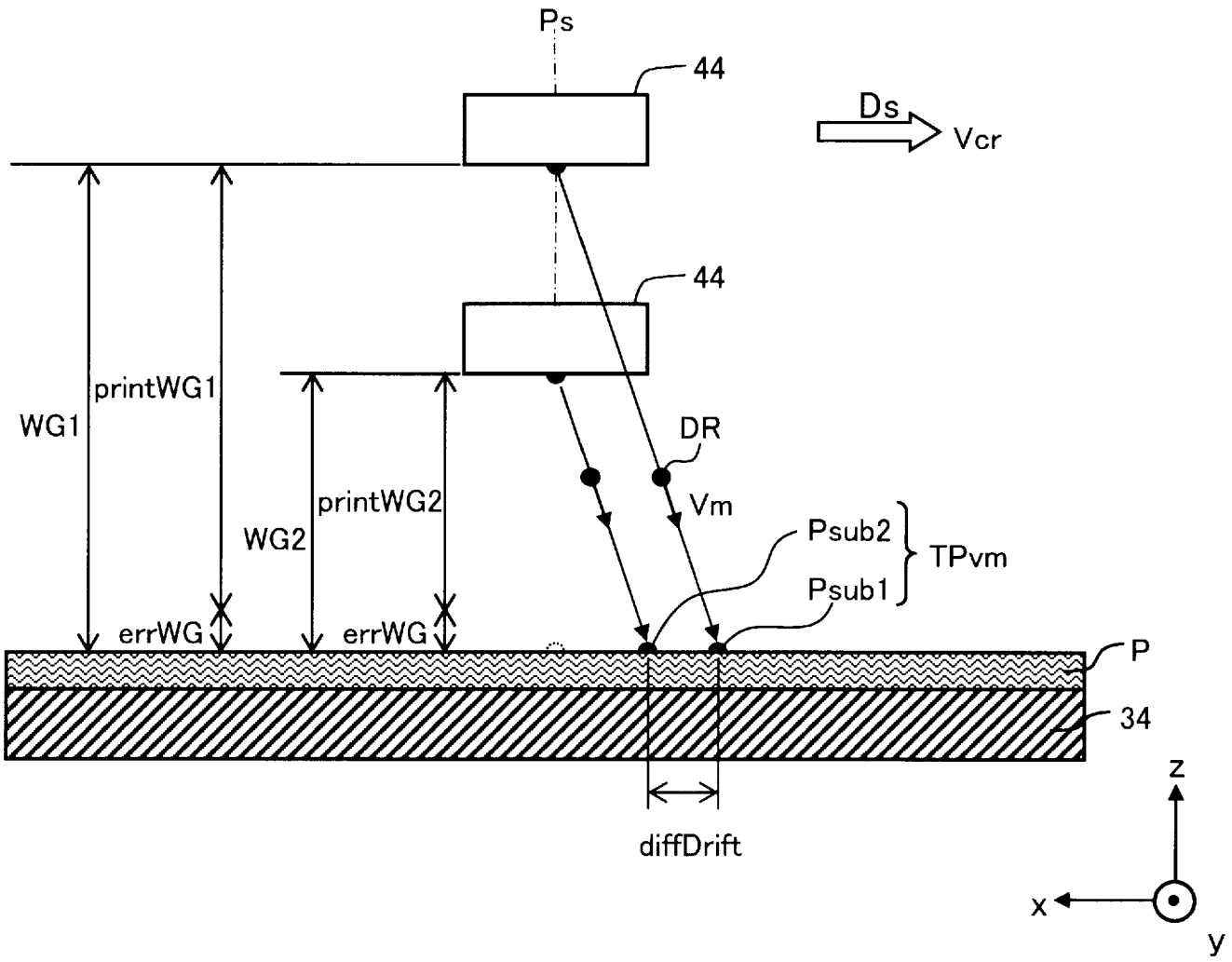
FIG. 5 is an explanatory diagram illustrating a process for determining a first correction component.

C. Process for Determining First Correction Component δ1:

FIG. 5 is an explanatory diagram illustrating a process for determining the first correction component δ1. Meanings of respective reference signs illustrated in FIG. 5 are as follows.

TPvm: an ejection velocity test pattern.

Psub1: a first sub-pattern constituting the ejection velocity test pattern TPvm.

Psub2: a second sub-pattern constituting the ejection velocity test pattern TPvm.

diffDrift: a distance between the first sub-pattern Psub1 and the second sub-pattern Psub2.

Vcr: the movement velocity of the printing head 44.

Vm: the ejection velocity of the ink droplet DR.

WG1, WG2: real values of the work gap between the medium P and the printing head 44. WG1=printWG1+errWG, and WG2=printWG2+errWG.

errWG: the work gap error, which is the mounting error of the printing head 44.

printWG1, printWG2: set values of the work gap inputted by the operator.

The test pattern printing execution unit 210 first forms the first sub-pattern Psub1 in a first condition in which the work gap WG has the first value WG1, and then forms the second sub-pattern Psub2 in a second condition in which the work gap WG has the second value WG2 different from the first value WG1. At this time, the first sub-pattern Psub1 and the second sub-pattern Psub2 are formed by respectively ejecting ink at timing when the printing head 44 reaches an identical specific position Ps while moving in the scanning direction Ds. In addition, the movement velocity Vcr of the printing head 44 when forming the first sub-pattern Psub1 and when forming the second sub-pattern Psub2 is identical. Further, the specific position Ps may also be said to be a "specific position in the scanning direction" because it is a specific position in the scanning direction Ds.

Figure 6:
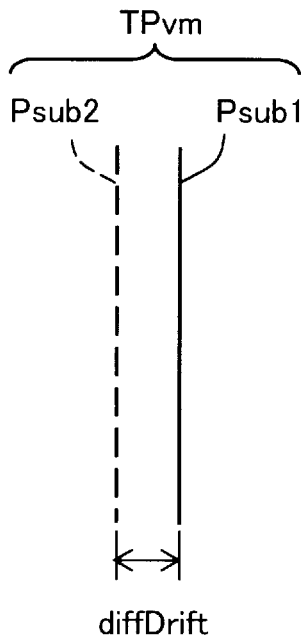
FIG. 6 is an explanatory diagram illustrating an example of an ejection velocity test pattern.

FIG. 6 is an explanatory diagram illustrating an example of the ejection velocity test pattern TPvm. The first sub-pattern Psub1 and the second sub-pattern Psub2 are formed using identical ink to have different shapes from each other. The distance diffDrift between the first sub-pattern Psub1 and the second sub-pattern Psub2 can be detected by acquiring an image of the ejection velocity test pattern TPvm using the camera unit 48, and analyzing the image by the correction value calculation unit 220. Instead, the operator of the printing apparatus 100 may observe the ejection velocity test pattern TPvm to detect the distance diffDrift, and input the detected distance diffDrift with the input device 120. In the latter case, for example, a plurality of the ejection velocity test patterns TPvm may be printed for which ink ejection timing is intentionally changed when forming the second sub-pattern Psub2, and the ejection velocity test pattern TPvm may be formed such that the distance diffDrift can be detected by the naked eye from the plurality of ejection velocity test patterns TPvm. Specifically, for example, in a case where a moiré is generated in one of the plurality of ejection velocity test patterns TPvm formed by intentionally changing the ejection timing, a value for identifying the distance diffDrift may be printed next to each of the ejection velocity test patterns TPvm, so that the distance diffDrift corresponding to an amount of change in the ejection timing when the moiré occurs may be detected by the naked eye. In this way, by observing the presence or absence of the moiré, the operator can detect the distance diffDrift. Note that, the distance diffDrift between the first sub-pattern Psub1 and the second sub-pattern Psub2 corresponds to an ejection velocity parameter detected by the ejection velocity test pattern TPvm.

As can be seen from FIG. 5, the distance diffDrift is given by the following Mathematical Equation.

[Mathematical Equation 2]

[Mathematical Equation 2]

$$diffDrift = \frac{Vcr \times (printWG1 + errWG)}{Vm} - \frac{Vcr \times (printWG2 + errWG)}{Vm}. \quad (2)$$

When the above Mathematical Equation 2 is modified, the ejection velocity Vm can be calculated using the following Mathematical Equation.

[Mathematical Equation 3]

[Mathematical Equation 3]

$$Vm = \frac{Vcr \times printWG1 - Vcr \times printWG2}{diffDrift}. \quad (3)$$

Using this ejection velocity Vm, the first correction component δ1 can be calculated according to Mathematical Equation 1b described above. Note that, the set value printWG of the work gap and the movement velocity Vcr in Mathematical Equation 1b are values when performing printing while carrying out correction of the ejection timing using the correction value δtotal.

Note that, the ejection velocity Vm of ink depends on a size of the ink droplet DR. In a case where the printing head 44 is capable of ejecting a plurality of ink droplets of different sizes, the ejection velocity Vm is determined using an ink droplet of one exemplary size. From the perspective of ease of recognition of the ejection velocity test pattern TPvm, an ink droplet of a maximum size may be used as the exemplary ink droplet. Ejection velocities of ink droplets of other sizes may be estimated from the ejection velocity Vm of the exemplary ink droplet, using a predetermined ejection velocity relationship. However, the ejection velocity Vm of the exemplary ink droplet may be applied to ink droplets of other sizes, without determining ejection velocities per sizes of the ink droplets.

As described above, in the present exemplary embodiment, the distance diffDrift as the ejection velocity parameter is detected from the ejection velocity test pattern TPvm, the ejection velocity Vm of liquid is calculated from the distance diffDrift, and the correction value δtotal including the first correction component δ1 that depends on the ejection velocity Vm is set. Accordingly, landing position deviation caused by an error in the ejection velocity Vm can be corrected.

Figure 7:
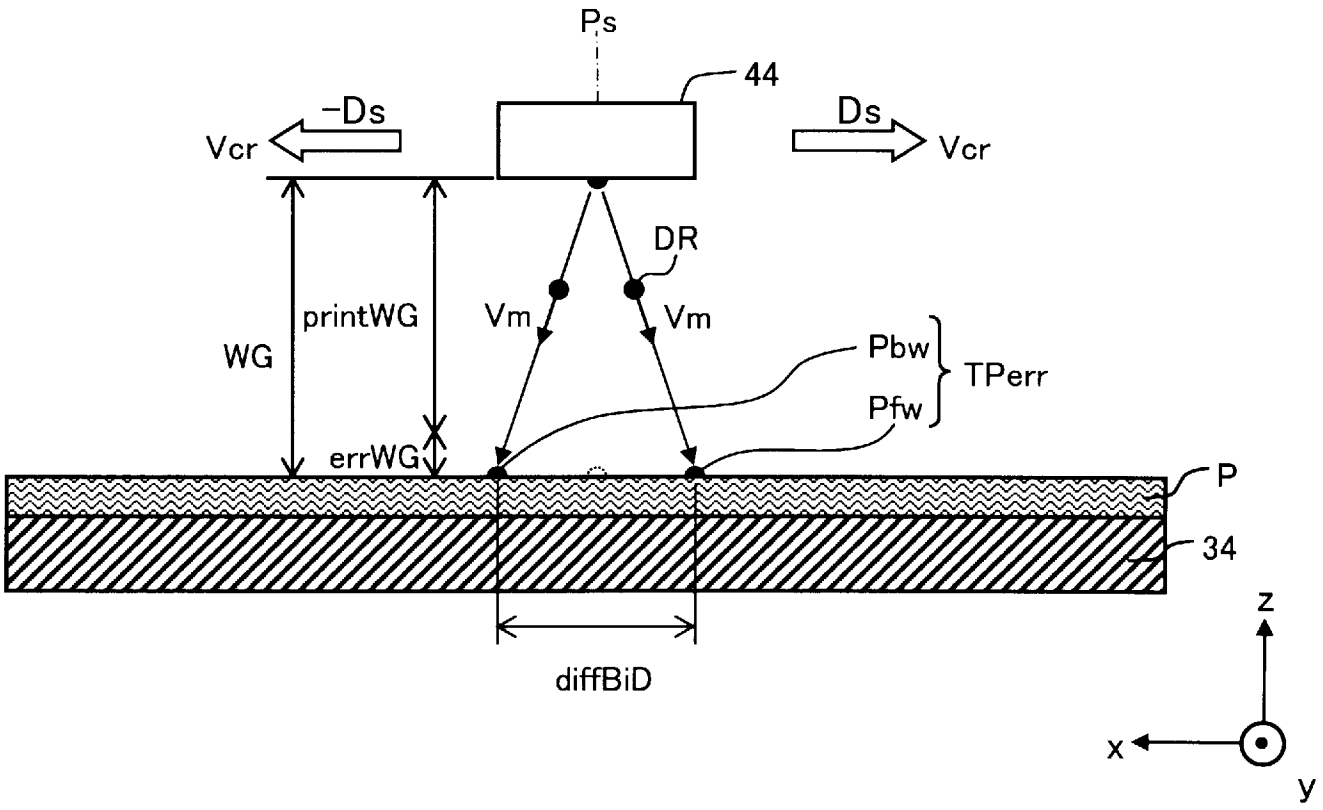
FIG. 7 is an explanatory diagram illustrating a process for determining a second correction component.

D. Process for Determining Second Correction Component δ2:

FIG. 7 is an explanatory diagram illustrating a process for determining the second correction component δ2. Meanings of respective reference signs illustrated in FIG. 7 are as follows.

TPerr: a mounting error test pattern.

Pfw: a forward path sub-pattern constituting the mounting error test pattern TPerr.

Pbw: a backward path sub-pattern constituting the mounting error test pattern TPerr.

diffBiD: a distance between the forward path sub-pattern Pfw and the backward path sub-pattern Pbw.

Vcr: the movement velocity of the printing head 44.

Vm: the ejection velocity of the ink droplet DR.

WG: the real value of the work gap between the medium P and the printing head 44, and WG=printWG+errWG.

errWG: the work gap error, which is the mounting error of the printing head 44.

printWG: the set value of a work gap inputted by the operator.

The test pattern printing execution unit 210 first forms the forward path sub-pattern Pfw while moving the printing head 44 in the forward path direction of scanning, and then forms the backward path sub-pattern Pbw while moving the printing head 44 in the backward path direction of the scanning. At this time, the forward path sub-pattern Pfw and the backward path sub-pattern Pbw are formed by respectively ejecting ink at the timing when the printing head 44 reaches the identical specific position Ps in the scanning direction Ds. In addition, the work gap WG is identical when forming the forward path sub-pattern Pfw and when forming the backward path sub-pattern Pbw. In the present exemplary embodiment, the movement velocity Vcr of the printing head 44 is identical when forming the forward path sub-pattern Pfw and when forming the backward path sub-pattern Pbw, but the movement velocity Vcr of the printing head 44 may be changed for the forward path and for the backward path.

As the forward path sub-pattern Pfw and the backward path sub-pattern Pbw, patterns of shapes similar to the first sub-pattern Psub1 and the second sub-pattern Psub2 of the ejection velocity test pattern TPvm can be used. The distance diffBiD between the forward path sub-pattern Pfw and the backward path sub-pattern Pbw can be detected by acquiring an image of the mounting error test pattern TPerr using the camera unit 48, and analyzing the image by the correction value calculation unit 220. Instead, the operator of the printing apparatus 100 may observe the mounting error test pattern TPerr to detect the distance diffBiD, and input the detected distance diffBiD with the input device 120. Note that, the distance diffBiD between the forward path sub-pattern Pfw and the backward path sub-pattern Pbw corresponds to a mounting error parameter detected by the mounting error test pattern TPerr.

As can be seen in FIG. 7, the distance diffBiD is given by the following Mathematical Equation.

[Mathematical Equation 4]

[Mathematical Equation 4]

$$diffBiD = \frac{Vcr \times (printWG + errWG)}{Vm} - \frac{-Vcr \times (printWG + errWG)}{Vm}. \quad (4)$$

When the above-described Mathematical Equation 4 is modified, the work gap error errWG can be calculated using the following Mathematical Equation.

[Mathematical Equation 5]

[Mathematical Equation 5]

$$errWG = \frac{diffBid \times Vm}{2 \times Vcr} - printWG. \quad (5)$$

When this work gap error errWG and the ejection velocity Vm are used, the second correction component δ2 can be calculated according to Mathematical Equation 1c described above. Note that, the work gap WG and the movement velocity Vcr in Mathematical Equation 1c are values when performing printing while carrying out correction of the ejection timing using the correction value δtotal.

As described above, in the present exemplary embodiment, the distance diffBiD as the mounting error parameter is detected from the mounting error test pattern TPerr, the work gap error errWG, which is the mounting error of the printing head 44 is calculated from the distance diffBiD and the ejection velocity Vm, and the correction value δtotal including the second correction component δ2 that depends on the work gap error errWG is set. Accordingly, landing position deviation caused by the work gap error errWG can be corrected.

Figure 8:
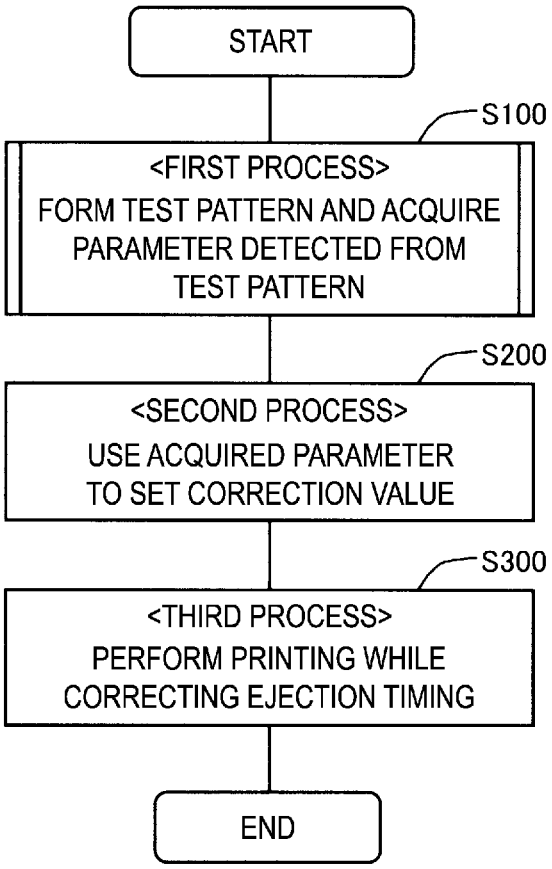
FIG. 8 is a flowchart illustrating a procedure of printing processing involving ejection timing correction.

E. Processing Procedure:

FIG. 8 is a flowchart illustrating a procedure of printing processing involving ejection timing correction. In step S100, a first processing is executed in response to a start instruction for calibration by the operator. The "calibration" means a process for acquiring a parameter for determining the correction value δtotal. The first processing is a process in which the test pattern printing execution unit 210 forms a test pattern, and the correction value calculation unit 220 acquires a parameter detected from the test pattern.

Figure 9:
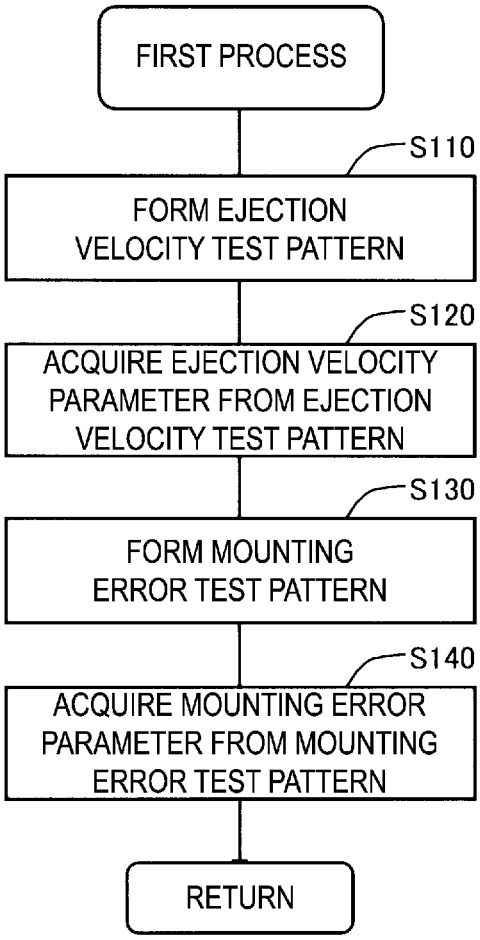
FIG. 9 is a flowchart illustrating a detailed procedure of a first processing.

FIG. 9 is a flowchart illustrating a detailed procedure of the first processing in step S100 in FIG. 8. In step S110, the ejection velocity test pattern TPvm illustrated in FIG. 5 is formed. In step S120, an ejection velocity parameter is detected from the ejection velocity test pattern TPvm, and acquired by the correction value calculation unit 220. As described above, in the present exemplary embodiment, the ejection velocity parameter is the distance diffDrift between the first sub-pattern Psub1 and the second sub-pattern Psub2. In step S130, the mounting error test pattern TPerr illustrated in FIG. 7 is formed. In step S140, a mounting error parameter is detected from the mounting error test pattern TPerr and acquired by the correction value calculation unit 220. As described above, in the present exemplary embodiment, the mounting error parameter is the distance diffBiD between the forward path sub-pattern Pfw and the backward path sub-pattern Pbw. Note that, when the correction value δtotal that does not include the second correction component δ2 is used to correct the ejection timing, step S130 and S140 can be omitted.

When the first processing ends, the processing proceeds to step S200, and a second processing is executed. In the second processing, the correction value calculation unit 220 sets the correction value δtotal of the ejection timing using the parameter acquired in the first processing. At this time, first, the ejection velocity Vm of ink is calculated according to Mathematical Equation 3 described above, and the work gap error errWG is calculated according to Mathematical Equation 5 described above. The correction value δtotal is given by Mathematical Equations 1a to 1e described above. However, as described above, some or all of the second to fourth correction components δ2 to δ4 can be omitted. In other words, in the second processing, the correction value δtotal is set to include at least the first correction component δ1. In the calculation of the correction value δtotal, as the set value printWG of the work gap and the movement velocity Vcr of the printing head 44, values at the time of printing specified by the operator are used. "At the time of printing" refers to the time of execution of a third processing described below. Note that, in the second processing, in a case where the set value printWG of the work gap at the time of printing and the movement velocity Vcr of the printing head 44 are not specified, these values may be set as variables. In this case, the value of the correction value δtotal is calculated at the start of the third processing.

When the second processing ends and an instruction for start of printing is inputted from the operator, the processing proceeds to step S300, and the third processing is executed. In the third processing, the control unit 110 performs the printing while correcting the ink ejection timing using the correction value δtotal. In other words, when the ink is ejected onto the medium P from the printing head 44 while moving the printing head 44, the ejection timing correction unit 230 corrects the ink ejection timing using the correction value δtotal.

Note that, the correction value δtotal provided by the above-described 1a to 1e is expressed in a unit of distance. In a case where the scanning driving unit 70 detects a position of the carriage 40 in the scanning direction Ds using an encoder, and performs control of ejecting ink droplets in synchronization with an encoder signal, the correction value δtotal itself can be used to correct the ejection timing. On the other hand, in a case where the control of ejecting ink droplets is performed in accordance with an elapsed time of scanning, a value δtotal/Vcr obtained by dividing the correction value δtotal by the movement velocity Vcr of the printing head 44 as a time correction value can be used to correct the ejection timing.

As described above, in the present exemplary embodiment, the ejection velocity Vm of the ink is calculated from the ejection velocity parameter detected by the ejection velocity test pattern TPvm, the correction value δtotal including the first correction component δ1 that depends on the ejection velocity Vm is set to correct the ejection timing of the ink, and thus landing position deviation caused by the error of the ejection velocity Vm can be corrected.

Note that, in the exemplary embodiment described above, the printing apparatus 100 that ejects the ink as the liquid ejecting device is used, but the present disclosure can be realized as a liquid ejecting device that ejects liquid other than ink.

F. Other Exemplary Embodiments

The present disclosure is not limited to the embodiments described above, and may be implemented in various aspects without departing from the spirits of the disclosure. For example, the present disclosure can be achieved in aspects described below. Appropriate replacements or combinations may be made to the technical features in the above-described embodiments which correspond to the technical features in the aspects described below to solve some or all of the problems of the disclosure or to achieve some or all of the advantageous effects of the disclosure. Additionally, when the technical features are not described herein as essential technical features, such technical features may be deleted appropriately.

(1) According to a first aspect of the present disclosure, there is provided a liquid ejecting device for ejecting liquid onto a medium. The liquid ejecting device includes a supporting unit configured to support the medium, an ejecting unit configured to eject the liquid onto the medium supported by the supporting unit, a scanning driving unit configured to move the ejecting unit along a scanning direction, and a control unit configured to control the ejecting unit and the scanning driving unit. The control unit is configured to be capable of performing, a first process for ejecting the liquid from the ejecting unit onto the medium to form an ejection velocity test pattern for determining an ejection velocity of the liquid, and acquiring an ejection velocity parameter associated with an ejection velocity of the liquid detected from the ejection velocity test pattern, a second processing for calculating an ejection velocity of the liquid from the ejection velocity parameter, calculating a first correction component that depends on the calculated ejection velocity, and setting a correction value including the first correction component, and a third processing for correcting ejection timing of the liquid using the correction value, when the liquid is ejected from the ejecting unit onto the medium as the ejecting unit is moved.

According to this liquid ejecting device, the ejection velocity of the liquid is calculated from the ejection velocity parameter detected by the ejection velocity test pattern, and the correction value including the first correction component that depends on the ejection velocity is set to correct the ejection timing, and thus landing position deviation caused by the error in the ejection velocity can be corrected.

(2) The above-described liquid ejecting device may further include, a gap adjusting unit that is capable of adjusting a work gap, which is a distance between the medium supported by the supporting unit and the ejecting unit, and the control unit may be configured to, in the first processing, while moving the ejecting unit in a scanning direction in a state where the work gap is at a first value, form a first sub-pattern by ejecting the liquid from the ejecting unit when the ejecting unit reaches a specific position in the scanning direction, form a second sub-pattern by ejecting the liquid from the ejecting unit when the ejecting unit reaches the specific position in the scanning direction, while moving the ejecting unit in the scanning direction in a state where the work gap is at a second value different from the first value, and form the ejection velocity test pattern including the first sub-pattern and the second sub-pattern.

According to this liquid ejecting device, the ejection velocity test pattern for determining the ejection velocity of the liquid can be formed, by ejecting the liquid in a state where the work gap is the first value and in a state where the work gap is the second value, respectively.

(3) In the above-described liquid ejecting device, the control unit may be configured to acquire a distance between the first sub-pattern and the second sub-pattern in the scanning direction as the ejection velocity parameter.

According to this liquid ejecting device, the distance between the first sub-pattern and the second sub-pattern depends on the ejection velocity of the liquid, and thus the ejection velocity can be calculated from the distance.

(4) In the above-described liquid ejecting device, the first correction component may be a component dependent on the ejection velocity, a set value of the work gap in the third processing, and a movement velocity of the ejecting unit in the third processing.

According to this liquid ejecting device, landing position deviation of the liquid depending on the ejection velocity of the liquid, the set value of the work gap, and the movement velocity of the ejecting unit can be corrected with the first correction component.

(5) In the above-described liquid ejecting device, the control unit may be configured to, (i) in the first processing, form a mounting error test pattern for determining a mounting error of the ejecting unit associated with a mounting position along an opposing direction in which the ejecting unit and the medium are opposed to each other, and acquire a mounting error parameter associated with a mounting error of the ejecting unit detected from the mounting error test pattern, and (ii) in the second processing, calculate a mounting error of the ejecting unit from the mounting error parameter and the ejection velocity, calculate a second correction component that depends on the calculated mounting error, and set the correction value including the second correction component.

According to this liquid ejecting device, the correction value is set in consideration of not only the ejection velocity of the liquid, but also the mounting error of the ejecting unit, thus the landing position deviation of the liquid can be more correctly corrected.

(6) In the above-described liquid ejecting device, the control unit may be configured to, in the first processing, while moving the ejecting unit in a scanning forward path direction in a state where a work gap, which is a distance between the medium supported by the supporting unit and the ejecting unit, is at a specific value, form a forward path sub-pattern by ejecting the liquid from the ejecting unit when the ejecting unit reaches a specific position in the scanning direction, and, while moving the ejecting unit in a scanning backward path direction in a state where the work gap is at the specific value, form a backward path sub-pattern by ejecting the liquid from the ejecting unit when the ejecting unit reaches the specific position in the scanning direction, and form the mounting error test pattern including the forward path sub-pattern and the backward path sub-pattern.

According to this liquid ejecting device, the mounting error test pattern can be formed at the medium for determining the mounting error of the ejecting unit in the scanning direction by ejecting the liquid while moving the ejecting unit in the forward path and the backward path respectively.

(7) In the above-described liquid ejecting device, the control unit may be configured to acquire a distance between the forward path sub-pattern and the backward path sub-pattern in the scanning direction as the mounting error parameter.

According to this liquid ejecting device, the distance between the forward path sub-pattern and the backward path sub-pattern depends on the mounting error of the ejecting unit in the scanning direction, and thus the ejection velocity can be calculated from the distance.

(8) In the above-described liquid ejecting device, the second correction component may be a component that depends on the ejection velocity, the mounting error of the ejecting unit, and the movement velocity of the ejecting unit in the third processing.

According to this liquid ejecting device, the landing position deviation of the liquid depending on the ejection velocity of the liquid, the mounting error of the ejecting unit, and the movement velocity of the ejecting unit can be corrected with the second correction component.

(9) In the above-described liquid ejecting device, the control unit may be configured to, in the second processing, calculate a third correction component that depends on an inclination error of the ejecting unit with respect to an opposing direction in which the ejecting unit and the medium are opposed to each other, a real value or a set value of a work gap, which is a distance between the medium and the ejecting unit in the third processing, and set the correction value including the third correction component.

According to this liquid ejecting device, the correction value is set in consideration of not only the ejection velocity of the liquid, but also the inclination error of the ejecting unit, thus the landing position deviation of the liquid can be more correctly corrected.

(10) In the above-described liquid ejecting device, the liquid ejecting device may include a plurality of the ejecting units, and the control unit may be configured to set the correction value for each ejecting unit.

According to this liquid ejecting device, the correction value is set for each of the plurality of ejecting units, and thus landing position deviation among the plurality of ejecting units can be corrected.

(11) In the above-described liquid ejecting device, the control unit may be configured to set the correction value to include a fourth correction component that depends on a mounting error of the plurality of ejecting units along the scanning direction.

According to this liquid ejecting device, the correction value is set in consideration of not only the ejection velocity of the liquid, but also the mounting error of the ejecting unit along the scanning direction, thus the landing position deviation of the liquid can be more correctly corrected.

(12) According to a second aspect of the present disclosure, a method for correcting landing position deviation of the liquid generated when ejecting liquid from an ejecting unit onto a medium supported by a supporting unit is provided. The method includes (a) a step for forming an ejection velocity test pattern for determining an ejection velocity of the liquid by ejecting the liquid from the ejecting unit onto the medium, and acquiring an ejection velocity parameter associated with an ejection velocity of the liquid detected from the ejection velocity test pattern, (b) a step for calculating an ejection velocity of the liquid from the ejection velocity parameter, calculating a first correction component that depends on the calculated ejection velocity, and setting a correction value including the first correction component, and (c) a step for correcting ejection timing of the liquid using the correction value, when the liquid is ejected from the ejecting onto the medium as the ejecting unit is moved.

According to this method, the ejection velocity of the liquid is calculated from the ejection velocity parameter detected by the ejection velocity test pattern, and the correction value including the first correction component that depends on the ejection velocity is set to correct the ejection timing, and thus landing position deviation caused by an error in the ejection velocity can be corrected.

What is claimed is:

1. A liquid ejecting device for ejecting liquid onto a medium, the liquid ejecting device comprising:

a supporting unit configured to support the medium;

an ejecting unit configured to eject the liquid onto the medium supported by the supporting unit;

a scanning driving unit configured to move the ejecting unit along a scanning direction; and a control unit configured to control the ejecting unit and the scanning driving unit, wherein the control unit is configured to perform, a first processing for ejecting the liquid from the ejecting unit onto the medium to form an ejection velocity test pattern for determining an ejection velocity of the liquid, and acquiring an ejection velocity parameter associated with the ejection velocity of the liquid detected from the ejection velocity test pattern, a second processing for calculating the ejection velocity of the liquid from the ejection velocity parameter, calculating a first correction component that depends on the calculated ejection velocity, and setting a correction value including the first correction component, and a third processing for correcting ejection timing of the liquid using the correction value, when the liquid is ejected from the ejecting unit onto the medium as the ejecting unit is moved, the liquid ejecting device further comprising:

a gap adjusting unit configured to adjust a work gap that is a distance between the medium supported by the supporting unit and the ejecting unit, wherein the control unit, in the first processing:

while moving the ejecting unit in a scanning direction in a state where the work gap is at a first value, causes the ejecting unit to eject the liquid, when the ejecting unit reaches a specific position in the scanning direction, to form a first sub-pattern, and while moving the ejecting unit in the scanning direction in a state where the work gap is at a second value different from the first value, causes the ejecting unit to eject the liquid, when the ejecting unit reaches the specific position in the scanning direction, to form a second sub-pattern, thereby forming the ejection velocity test pattern including the first sub-pattern and the second sub-pattern.

2. The liquid ejecting device according to claim 1, wherein the control unit acquires a distance between the first sub-pattern and the second sub-pattern in the scanning direction as the ejection velocity parameter.

3. The liquid ejecting device according to claim 1, wherein the first correction component is a component that depends on the ejection velocity, a set value of the work gap in the third processing, and a movement velocity of the ejecting unit in the third processing.

4. The liquid ejecting device according to claim 1, wherein the control unit, in the second processing, calculates a third correction component that depends on an inclination error of the ejecting unit with respect to an opposing direction in which the ejecting unit and the medium are opposed to each other, a real value or a set value of a work gap that is a distance between the medium and the ejecting unit in the third processing, and sets the correction value including the third correction component.

5. The liquid ejecting device according to claim 1, wherein the liquid ejecting device includes a plurality of the ejecting units, and the control unit sets the correction value for each ejecting unit.

6. The liquid ejecting device according to claim 5, wherein the control unit sets the correction value to include a fourth correction component that depends on a mounting error of the plurality of ejecting units along the scanning direction.

7. A liquid ejecting device for ejecting liquid onto a medium, the liquid ejecting device comprising:

a supporting unit configured to support the medium;

an ejecting unit configured to eject the liquid onto the medium supported by the supporting unit;

a scanning driving unit configured to move the ejecting unit along a scanning direction; and a control unit configured to control the ejecting unit and the scanning driving unit, wherein the control unit is configured to perform, a first processing for ejecting the liquid from the ejecting unit onto the medium to form an ejection velocity test pattern for determining an ejection velocity of the liquid, and acquiring an ejection velocity parameter associated with the ejection velocity of the liquid detected from the ejection velocity test pattern, a second processing for calculating the ejection velocity of the liquid from the ejection velocity parameter, calculating a first correction component that depends on the calculated ejection velocity, and setting a correction value including the first correction component, and a third processing for correcting ejection timing of the liquid using the correction value, when the liquid is ejected from the ejecting unit onto the medium as the ejecting unit is moved, wherein the control unit, (i) in the first processing, forms a mounting error test pattern for determining a mounting error of the ejecting unit relating to a mounting position along an opposing direction in which the ejecting unit and the medium are opposed to each other, and acquires a mounting error parameter associated with the mounting error of the ejecting unit detected from the mounting error test pattern, and (ii) in the second processing, calculates a mounting error of the ejecting unit from the mounting error parameter and the ejection velocity, calculates a second correction component that depends on the calculated mounting error, and sets the correction value including the second correction component.

8. The liquid ejecting device according to claim 7, wherein, the control unit, in the first processing, while moving the ejecting unit in a scanning forward path direction in a state where a work gap that is a distance between the medium supported by the supporting unit and the ejecting unit is at a specific value, causes the ejecting unit to eject the liquid, when the ejecting unit reaches a specific position in the scanning direction, to form a forward path sub-pattern, and while moving the ejecting unit in a scanning backward path direction in a state where the work gap is at the specific value, causes the ejecting unit to eject the liquid, when the ejecting unit reaches the specific position in the scanning direction, to form a backward path sub-pattern, thereby forming the mounting error test pattern including the forward path sub-pattern and the backward path sub-pattern.

9. The liquid ejecting device according to claim 8, wherein the control unit acquires a distance between the forward path sub-pattern and the backward path sub-pattern in the scanning directions as the mounting error parameter.

10. The liquid ejecting device according to claim 7, wherein the second correction component is a component that depends on the ejection velocity, the mounting error of the ejecting unit, and a movement velocity of the ejecting unit in the third processing.

11. A method for correcting landing position deviation of liquid generated when the liquid is ejected from an ejecting unit onto a medium supported by a supporting unit, the method comprising:

(a) ejecting the liquid from the ejecting unit onto the medium to form an ejection velocity test pattern for determining an ejection velocity of the liquid, and acquiring an ejection velocity parameter associated with the ejection velocity of the liquid detected from the ejection velocity test pattern, (b) calculating the ejection velocity of the liquid from the ejection velocity parameter, calculating a first correction component that depends on the calculated ejection velocity, and setting a correction value including the first correction component, and (c) correcting ejection timing of the liquid using the correction value, when the liquid is ejected from the ejecting unit onto the medium as the ejecting unit is moved, wherein while forming the ejection velocity test pattern:

while moving the ejecting unit in a scanning direction in a state where a work gap that is a distance between the medium supported by the supporting unit and the ejecting unit is at a first value, causing the ejecting unit to eject the liquid, when the ejecting unit reaches a specific position in the scanning direction, to form a first sub-pattern, and while moving the ejecting unit in the scanning direction in a state where the work gap is at a second value different from the first value, causing the ejecting unit to eject the liquid, when the ejecting unit reaches the specific position in the scanning direction, to form a second sub-pattern, thereby forming the ejection velocity test pattern including the first sub-pattern and the second sub-pattern.

* * * * *